US007121274B2

(12) United States Patent
Wishart

(10) Patent No.: US 7,121,274 B2
(45) Date of Patent: Oct. 17, 2006

(54) COMPLETE OUTDOOR KITCHEN

(76) Inventor: Randell Joseph Wishart, 316 California Ave. #324, Reno, NV (US) 89509

( * ) Notice: Subject to any disclaimer, the term of this patent is extended or adjusted under 35 U.S.C. 154(b) by 0 days.

(21) Appl. No.: 10/686,001

(22) Filed: Oct. 16, 2003

(65) Prior Publication Data

US 2005/0103321 A1 May 19, 2005

(51) Int. Cl.
*F24C 1/00* (2006.01)

(52) U.S. Cl. ..... 126/57; 126/56; 126/25 R; 126/9 R; 126/9 B

(58) Field of Classification Search ..... 126/57, 126/56, 25 R, 29, 30, 9 R, 9 B; 312/107, 312/198, 236, 228; 224/403, 404, 495, 534, 224/543, 544
See application file for complete search history.

(56) References Cited

U.S. PATENT DOCUMENTS 1,919,898 A * 7/1933 Martin ..... 126/38
2,944,862 A * 7/1960 Heil ..... 312/237
3,915,529 A * 10/1975 Bernier ..... 312/237
5,862,540 A * 1/1999 Chuan ..... 4/449
5,913,270 A * 6/1999 Price ..... 108/101
6,079,400 A * 6/2000 Tomat Dany ..... 126/37 B
6,543,436 B1 * 4/2003 Montgomery ..... 123/38
6,814,383 B1 * 11/2004 Reed et al. ..... 296/24.3
6,836,910 B1 * 1/2005 Cawthon ..... 4/650
6,840,182 B1 * 1/2005 Price ..... 108/101
6,883,881 B1 * 4/2005 Gauss ..... 312/237

* cited by examiner

*Primary Examiner*—Alfred Basichas
(74) *Attorney, Agent, or Firm*—James M. Ritchey

(57) ABSTRACT

A complete Outdoor Kitchen. A modular and connected array of kitchen cabinets; BBQ; kitchen sink with running water; powered standard household appliances; refrigerator, coffee maker, juicer, toaster, microwave. This system allows the Outdoor Kitchen the ability to greatly improve the organization of food preparation, allows for improved food storage, improved health and safety of food and cleaning. The Outdoor Kitchen collapses and hinges closed into a compact rain tight box approximately the size of a pick-up tool box. This kitchen unit can be used as a commercial vending unit for tailgate parties, camping or on your patio at home. This kitchen unit can be fitted for use in a pick-up truck bed, rear bumper of a car, rear bumper of a van, or rear bumper of an RV. It can also be built into the side of an RV.

15 Claims, 3 Drawing Sheets

COMPLETE OUTDOOR KITCHEN

BACKGROUND OF THE INVENTION

1) Field of the Invention

An invention that addresses the need for improved health and safety of outdoor cooking, i.e.

a) Safety in the storage of fresh foods for long periods of time that must be refrigerated or kept frozen.

b) Safety in storing other types of foods away from germ carrying insects.

c) Provides built in sink and running water for sanitary dish washing.

d) Provides enhanced clean, organized, convenient storage for non refrigerated foods.

e) Provides enhanced clean, organized, convenient storage for cooking utensils, just like in your kitchen at home.

The invention, in addition is a complete kitchen that is portable, collapsible for easy transportation and storage, rain tight when closed for storage, and is self contained with:

a) A small generator, inverter, solar or battery powered electrical supply.

b) Its own water supply.

The Kitchen can be fitted to be transported by a pick-up truck, a van, on the rear of a car, on the rear of an RV or built into the side of an RV cargo area on slides.

The Kitchen can optionally be used as a free standing unit on a rolling stand that can be used all year long on your back yard deck or patio.

2) Description of the Background Art

Conventional outdoor cooking, whether out camping, at tailgate parties, special events or commercial street vending is a disorganized and sometimes unsanitary process. It consists of a collection of ice chests, shopping bags, BBQ's, pots, pans, and utensils. All of this is to be able to cook meals in the open air.

Several camping box designs have been developed in an attempt to solve some of the universal health, safety and storage problems with cooking outdoors. None, however, have disclosed a collapsible, complete kitchen array with improved dry storage, cold storage, utensil storage, sanitary food preparation areas, water supply and electrical power supply as provided in this invention.

U.S. Pat. No. 6,189,944 B1, issued on Feb. 20, 2001 reveals a food service kiosk in the shape of a vehicle.

U.S. Pat. No. 5,269,599, issued on Dec. 14, 1993 reveals a cabinet designed for the storage of basic kitchen utensils, cookware and food stuffs designed for use by campers and work crews in remote locations.

U.S. Pat. No. 5,913,270 issued Jun. 22, 1999 reveals a portable modular field kitchen including a horizontal work surface and main frame for supporting and stabilizing a work surface.

U.S. Pat. No. 5,683,157, issued on Nov. 4, 1997 reveals a portable kitchen for storing and preparing food products comprising a main box having a table, a sink and front panel.

U.S. Pat. No. 376,933 issued Dec. 31, 1996 reveals a portable kitchen cabinet.

U.S. Pat. No. 5,349,708 issued Sep. 27, 1994 reveals a foldable kitchen sink suitable for use as either an outdoor sink or outdoor table with an attachable outdoor grille and/or outdoor dishwater bucket.

U.S. Pat. No. 311,114 issued Oct. 9, 1990 reveals a tailgater portable kitchen w/cabinets.

U.S. Pat. No. 291,047 issued Jul. 28, 1987 reveals a portable outdoor kitchen with deep fat fryer on rollers.

U.S. Pat. No. 4,131,327 issued Dec. 26, 1978 reveals a portable picnic and camping cabinet table for storing picnic and camping supplies.

U.S. Pat. No. 4,706,817, issued Nov. 17, 1987 reveals a portable food holding device comprising a table section with foldable legs and cover adapted to maintain food in chilled or heated condition.

U.S. Pat. No. 5,188,234 issued Feb. 23, 1993 reveals a kit comprising a lunchbox and carrying pouch.

U.S. Pat. No. 5,257,509 issued Nov. 2, 1993 reveals a container converting between a briefcase, a food and beverage carriage, and mini cooler.

U.S. Pat. No. 5,261,560 issued Nov. 16, 1993 reveals a receptacle for a spoon and fork.

U.S. Pat. No. 6,343,545 B1 issued Feb. 5, 2002 reveals a grill or kitchen unit for outdoor use and includes a cooking unit which is translatable between a position over a heat source and a position laterally adjacent to the heat source.

U.S. Pat. No. 5,579,914, issued Dec. 3, 1996 reveals a camping kitchen caddy comprising a carrying case having first and second pivotally connectable case members, a chopping board, and a compartment form fitted to receive a frying pan and a coffee pot.

U.S. Pat. No. 5,862,540, issued Jan. 26, 1999 reveals a portable kitchen, toilet and shower unit including a sink bowl, a sink tap, a work top, a cupboard, and a water container.

SUMMARY OF THE INVENTION

An object of the present invention is to provide a larger unit with the benefit of a more sanitary outdoor storage of cold and dry foods for use.

Another object of the present invention is to allow for more organized, sanitary, and safe food preparation and cooking surface areas.

A further object of the invention is to supply a built-in sink and water storage for a more sanitary dishwashing arrangement.

Still another object of the invention is to allow the unit to close up into a compact, rain tight box for easy transportation and storage.

Yet another object of the invention is its optional legs with wheels for use anywhere, including your back yard.

Still a further object of the invention is its commercial use for street type vendors.

Yet a further object of the invention is that it provides a heretofore missing link between the tent camper cooking on the ground and the beginning level RV i.e., the tent trailer.

Still a further object of the invention is its collapsibility into a compact unit for transportation and storage.

Yet a further object of the invention is its multiple configurations, i.e., hinging open and/or modular stacking.

Yet a further objective of the invention is its automatic alignment/leveling of the sink and top to its opened down, horizontal position. The unit's sink side swivel/pivot point connection with its integral support cable, allows this automatic leveling when (manually) first tipped out, then it swings out and around to its opened level position.

Still a further object of the invention is its portable use when not attached to a vehicle. The optional legs, with wheels (the dolly) includes jacks that attach to both sides of the unit, lift it up and allow it to be rolled to anywhere it is to be used. The stand, legs and wheels can remain attached when opened for use.

Overhead views of the invention fully closed for storage/transportation.

FIG. 2.

Overhead views of the invention with the BBQ cabinet hinged open.

FIG. 3.

Overhead views of the invention with the BBQ cabinet hinged open and the first stage opening (hinge away of the top edge) of the sink/countertop.

FIG. 4.

Overhead views of the invention with the BBQ cabinet hinged open and the first stage opening (hinge away of the top edge) of the sink/countertop along with the second stage opening (pivot away, down and around) of the sink/countertop to the half way open position.

FIG. 5.

Overhead views of the invention with the BBQ cabinet hinged open and the first stage opening (hinge away of the top edge) of the sink/countertop, along with the second stage opening (pivot away, down and around) of the sink/countertop to the half way open position. Also the next stage with the fully opened sink/countertop along with the view of the BBQ in the hinged down for use position.

FIG. 6

A side angle view of the Complete Outdoor Kitchen in the fully opened position.

DESCRIPTION OF THE PREFERRED EMBODIMENT

Figure 1:
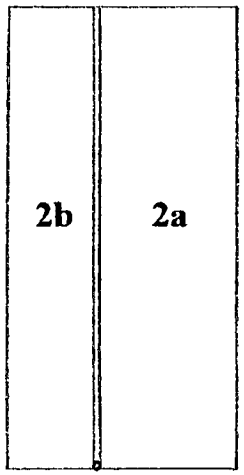
FIG. 1.
Figure 2:
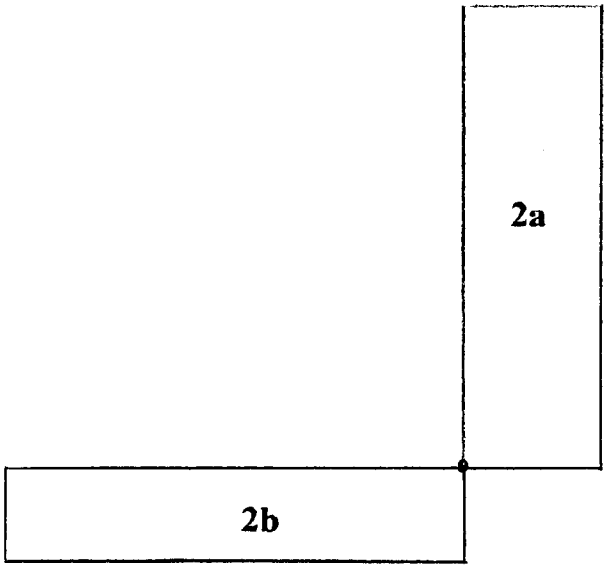
Figure 3:
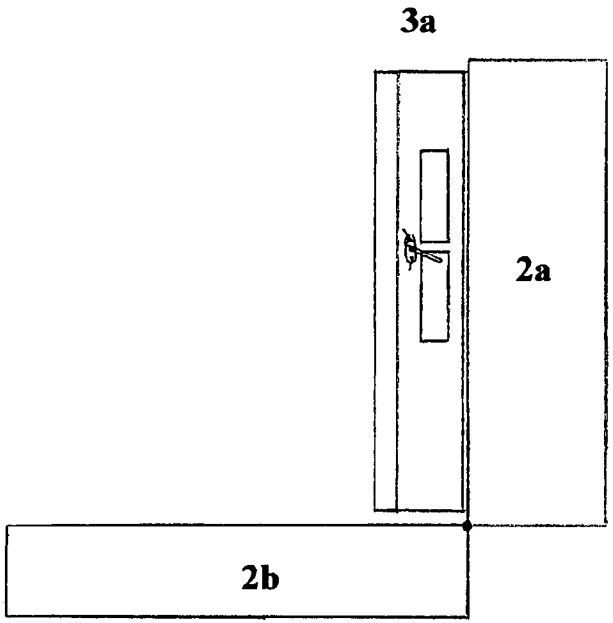
Figure 4:
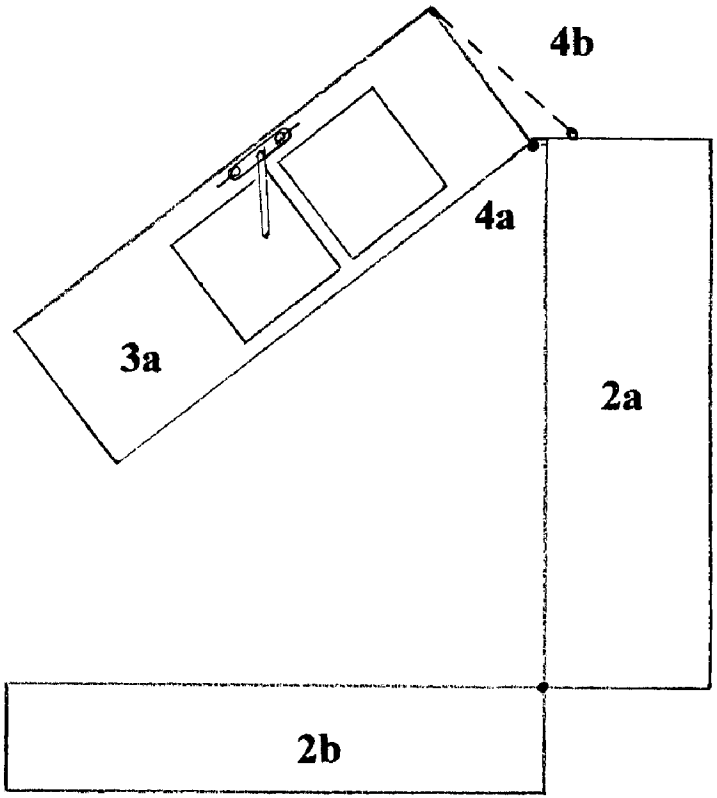
Figure 5:
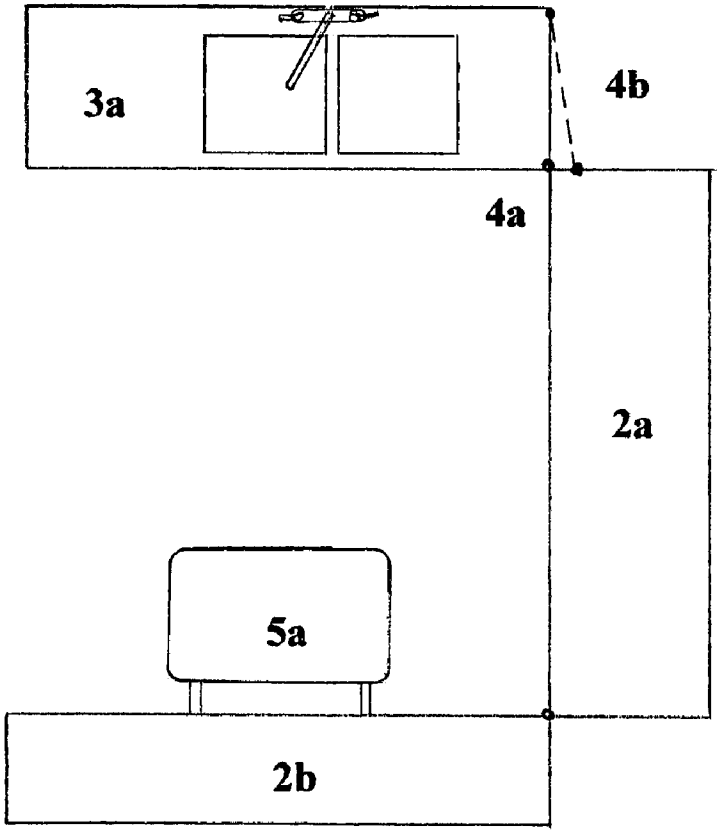
Figure 6:
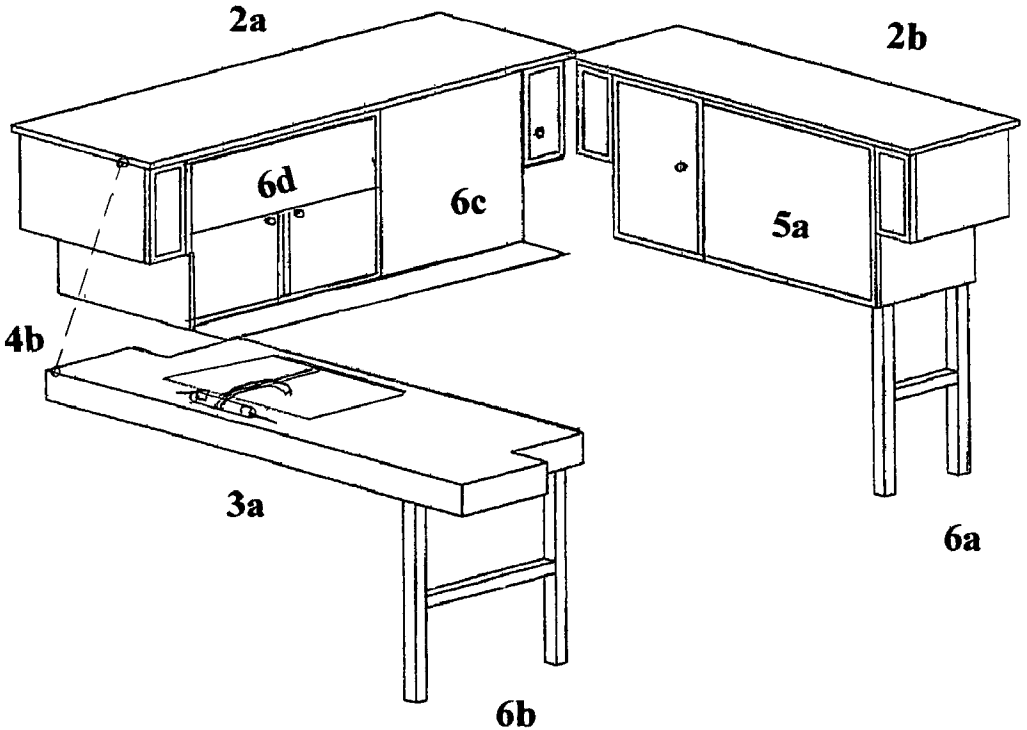

Referring now to FIGS. 1–6, there is shown a preferred embodiment of a Complete Outdoor Kitchen. While the preferred embodiment displays a certain arrangement of the various cabinets, counters and appliances, other embodiments are contemplated. FIG. 1. is an overhead view of the closed for storage/travel Complete Outdoor Kitchen (The Unit); the Complete Outdoor Kitchen comprising of a main cabinet box, (2*a*), a side BBQ cabinet (2*b*) and a sink/countertop (3*a*).

The Complete Outdoor Kitchen (The Unit) can be loaded into or attached onto any car, van, RV or pick-up truck. When the unit is loaded into a pick-up truck, the unit can be used while it sits on the tailgate. First the unit is placed at the front of the bed of the pick-up, just like a tool box. Second, when you have arrived at a desired site for use, the unit is rolled to the edge of the pick-up tailgate (built in rollers not shown). The unit is then tethered to the front of the pick-up bed so that the unit stops at the edge of the tailgate and cannot roll out of the bed. Next the hinge down legs (6*a*) of the BBQ cabinet (2*b*) are hinged into the open position. Next the BBQ cabinet (2*b*) is hinged out to the open position. Next the hinge down legs (6*b*) of the sink/countertop (3*a*) are hinged into the open position. Next the sink/countertop (3*a*) is lowered away from the main cabinet (2*a*) on its hinging/pivot point (4*a*) until its restraining cable/chain arm (4*b*) stops it. Next the sink/countertop (3*a*) is swung out and around on its hinging/pivot point (4*a*) of attachment until it automatically finds its opened and level stopping point FIG. 5 & (3*a*). Last the hinge down BBQ can be lowered for use (5a) with Refrigerator (6*c*) and microwave (6*d*).

What is claimed is:

1. A compact vehicle-portable kitchen system, comprising:

a) a rain-tight enclosure comprising:

i) a front section having a front internal volume;

ii) a rear section having a rear internal volume;

iii) hinge means secured to and between said front section and said rear section, wherein said front and said rear sections hingeably mate against one another in a hinged closed configuration to produce said rain-tight enclosure;

b) an extendable work-area member pivotably secured to said rear section, whereby said extendable work-area member fits within said rain-tight enclosure when said rain-tight enclosure is in said closed configuration and pivotably extends from said rain-tight enclosure when said front section and said rear section are in a hinged open configuration;

c) first and second supports, wherein said first support is collapseably secured to said extendable work-area member and said second support is collapseably secured to said front section of said enclosure; and d) a plurality of kitchen appliances mounted within said rain-fight enclosure.

2. A compact vehicle-portable kitchen system according to claim 1, wherein said rear section is releasably secured to the vehicle.

3. A compact vehicle-portable kitchen system according to claim 1, wherein said front section contains a cooking device within said front internal volume.

4. A compact vehicle-portable kitchen system according to claim 1, wherein said mar section contains a refrigerator within said rear internal volume.

5. A compact vehicle-portable kitchen system according to claim 1, wherein said extendable work-area member holds a sink and countertop work-surface.

6. A compact vehicle-portable kitchen system according to claim 1, wherein said front and rear sections contain a plurality of storage spaces.

7. A compact vehicle-portable kitchen system according to claim 1, wherein said extendable work-area member is secured to said rear section via a pivot point attachment means and a restraining means.

8. A compact vehicle-portable kitchen system, comprising:

a) a first housing half having a first interior volume and first, second, third, and forth perimeter edges surrounding said first interior volume;

b) a second housing half having a second interior volume and fifth, sixth, seventh, and eighth perimeter edges surrounding said second interior volume;

c) hinge means for pivotally mating said first and second housing halves to one another at said first and fifth perimeter edges, thereby producing a rain-tight enclosure when all said perimeter edges are closed to fit against one another and an open user-accessible configuration when said second, third, and forth perimeter edges pivot away from said sixth, seventh, and eighth perimeter edges;

d) an extendable work-area member pivotably secured to said first housing half proximate said third perimeter edge, whereby said extendable work-area member fits within said rain-tight enclosure when said rain-tight enclosure is in said closed configuration and pivotably extends from said rain-tight enclosure when said front section and said rear section are in a hinged open configuration; and e) a plurality of kitchen appliances mounted within said first and second interior volumes.

9. A compact vehicle-portable kitchen system according to claim 8, further including first and second supports, wherein said first support is collapseably secured to said extendable work-area member and said second support is collapseably secured to said second housing half.

10. A compact vehicle-portable kitchen system according to claim 8, wherein said first housing half is releasably secured to the vehicle.

11. A compact vehicle-portable kitchen system according to claim 8, wherein said second housing half contains a cooking device within said second interior volume.

12. A compact vehicle-portable kitchen system according to claim 8, wherein said first housing half contains a refrigerator within said first interior volume.

13. A compact vehicle-portable kitchen system according to claim 8, wherein said extendable work-area member holds a sink and countertop work-surface.

14. A compact vehicle-portable kitchen system according to claim 8, wherein said first and second housing halves contain a plurality of storage spaces.

15. A compact vehicle-portable kitchen system according to claim 8, wherein said extendable work-area member is secured to said first housing half via a pivot point attachment means and a restraining means.

* * * * *